US007433621B2

(12) United States Patent
Shibaki et al.

(10) Patent No.: US 7,433,621 B2
(45) Date of Patent: Oct. 7, 2008

(54) IMAGE FORMING APPARATUS THAT ALLOWS AN ADJUSTABLE INTERVAL FOR ADJUSTING AN IMAGE

(75) Inventors: Sejii Shibaki, Toride (JP); Tadaaki Saida, Kashiwa (JP); Shunsaku Kondo, Toride (JP); Ryuta Mine, Toride (JP)

(73) Assignee: Canon Kabushiki Kaisha (JP)

( * ) Notice: Subject to any disclaimer, the term of this patent is extended or adjusted under 35 U.S.C. 154(b) by 146 days.

(21) Appl. No.: 11/470,702

(22) Filed: Sep. 7, 2006

(65) Prior Publication Data

US 2007/0053710 A1 Mar. 8, 2007

(30) Foreign Application Priority Data

Sep. 8, 2005 (JP) ..... 2005-260903

(51) Int. Cl.
*G03G 15/00* (2006.01)

(52) U.S. Cl. ..... 399/81; 399/43

(58) Field of Classification Search ..... 399/38, 399/43, 46, 81, 82
See application file for complete search history.

(56) References Cited

U.S. PATENT DOCUMENTS 5,285,242 A * 2/1994 Kotani ..... 399/43
6,385,412 B1 * 5/2002 Sadakuni ..... 399/43 X

FOREIGN PATENT DOCUMENTS

JP 10-307448 11/1998

* cited by examiner

*Primary Examiner*—Sandra L Brase
(74) *Attorney, Agent, or Firm*—Rossi, Kimms & McDowell LLP

(57) ABSTRACT

An image forming apparatus including an adjustment unit adapted to adjust an image to be formed by an image forming unit advises the next adjustment execution timing on the basis of cumulative use information obtained by the image forming unit, and changes the advised adjustment timing on the basis of selection input.

4 Claims, 5 Drawing Sheets

AUTOMATIC ADJUSTMENT MODE

INHIBIT ADJUSTMENT DURING EXECUTION OF JOB

EXECUTE ADJUSTMENT AT BEGINNING OF JOB

IMAGE FORMING APPARATUS THAT ALLOWS AN ADJUSTABLE INTERVAL FOR ADJUSTING AN IMAGE

BACKGROUND OF THE INVENTION

1. Field of the Invention

The present invention relates to an image forming technique and, more particularly, to an image forming apparatus which advises the user of an adjustment execution timing in image formation and controls that adjustment execution timing.

2. Description of the Related Art

Conventionally, an electrophotographic image forming apparatus is known to suffer a change in image density due to, e.g., a change in photosensitive body or developing unit over a long period of time or a change in temperature or humidity of its ambient environment. To solve this problem, there is proposed a technique for adjusting a parameter factor, e.g., a charging bias or developing bias, which influences the density of a toner image, at an appropriate timing to stabilize the image density.

For example, to form a color image using a plurality of image carriers, such a technique detects predetermined pattern information (test patch) transferred onto a common transfer means such as a transfer belt which transfers visual images on the image carriers onto a transfer material. After that, it is a common practice to execute a method of controlling the toner density, a method of controlling the exposure amount, or a method of measuring the density of the test patch and correcting process conditions according to an image forming means.

To form a color image using a plurality of image carriers, there is also known a method of detecting a test patch and correcting timings to visualize images on the corresponding image carriers so as to correct color misregistration.

These image adjustment processes are periodically executed over a predetermined period of time when an image forming apparatus has satisfied a predetermined condition such as a preset cumulative print count. For example, if the current print count has reached a cumulative print count during execution of an image formation job, an image adjustment process is sometimes performed. In this case, for example, the current image density sometimes changes after the image adjustment process. Therefore, only periodical execution of an image adjustment process under a predetermined condition is insufficient to appropriately adjust degradation in quality of an image to be formed.

To solve this problem, Japanese Patent Application Laid-Open No. 10-307448 discloses an apparatus having an image adjustment function of allowing the user to execute an image adjustment process by manual operation if he/she determines that it is necessary.

Unfortunately, when the user is allowed to execute adjustment processes simply by manual operation in the image forming apparatus disclosed in Japanese Patent Application Laid-Open No. 10-307448 described above, the following problems arise.

(1) Even immediately after the image forming apparatus has automatically executed an image adjustment process, the user cannot know time when the image adjustment process has been executed. In this case, the user may execute the image adjustment process by manual operation by mistake. This wastes consumables used for the image forming adjustment process and the time required for the image adjustment process.

(2) In particular, even when a print job including a small number of pages which may be printed with little concern for degradation in image quality is to be processed in a short period of time, an image adjustment process is uniformly, automatically executed on the basis of a predetermined condition. Since the image adjustment process is performed during execution of the print job, processing of the print job is interrupted. This greatly prolongs the processing time of the print job.

(3) Even when image adjustment has been executed by manual operation, if the image adjustment process is automatically executed on the basis of a predetermined condition, the current image quality changes after the image adjustment process in processing one print job as described above.

The present invention has been made in consideration of the above problems in the prior arts, and has as its object to provide an image forming technique for allowing the user to grasp a criterion until the next image adjustment process execution, so as to select an image adjustment process execution schedule in accordance with the degree of degradation in image or an image formation job to be processed.

SUMMARY OF THE INVENTION

In order to achieve the above object, according to the present invention, there is provided an image forming apparatus comprising the following arrangement.

According to the present invention, it is possible to provide an image forming technique for allowing the user to grasp a criterion until the next image adjustment process execution, so as to select an image adjustment process execution schedule in accordance with the degree of degradation in image or an image formation job to be processed.

According to the present invention, the foregoing object is attained by providing an image forming apparatus comprising:

an adjustment unit adapted to adjust an image to be formed by an image forming unit;

a display control unit adapted to advise a combination of quantitative information indicating a next adjustment timing obtained by the adjustment unit and ratio information of cumulative use information obtained by the image forming unit to an adjustment interval obtained by the adjustment unit; and a timing control unit adapted to change the advised adjustment timing to be earlier or later than the next adjustment timing on the basis of selection input, wherein the display control unit displays, on the same display unit, the advised combination of the quantitative information and the ratio information and a selection input window to change the adjustment timing.

The present invention makes it possible to avoid wastefully repeating an image adjustment process and to prevent the occurrence of a variation in image quality and a delay in processing time upon starting the image adjustment process.

Further features of the present invention will become apparent from the following description of exemplary embodiments (with reference to the attached drawings).

DESCRIPTION OF THE EMBODIMENTS

First Embodiment

Figure 1:
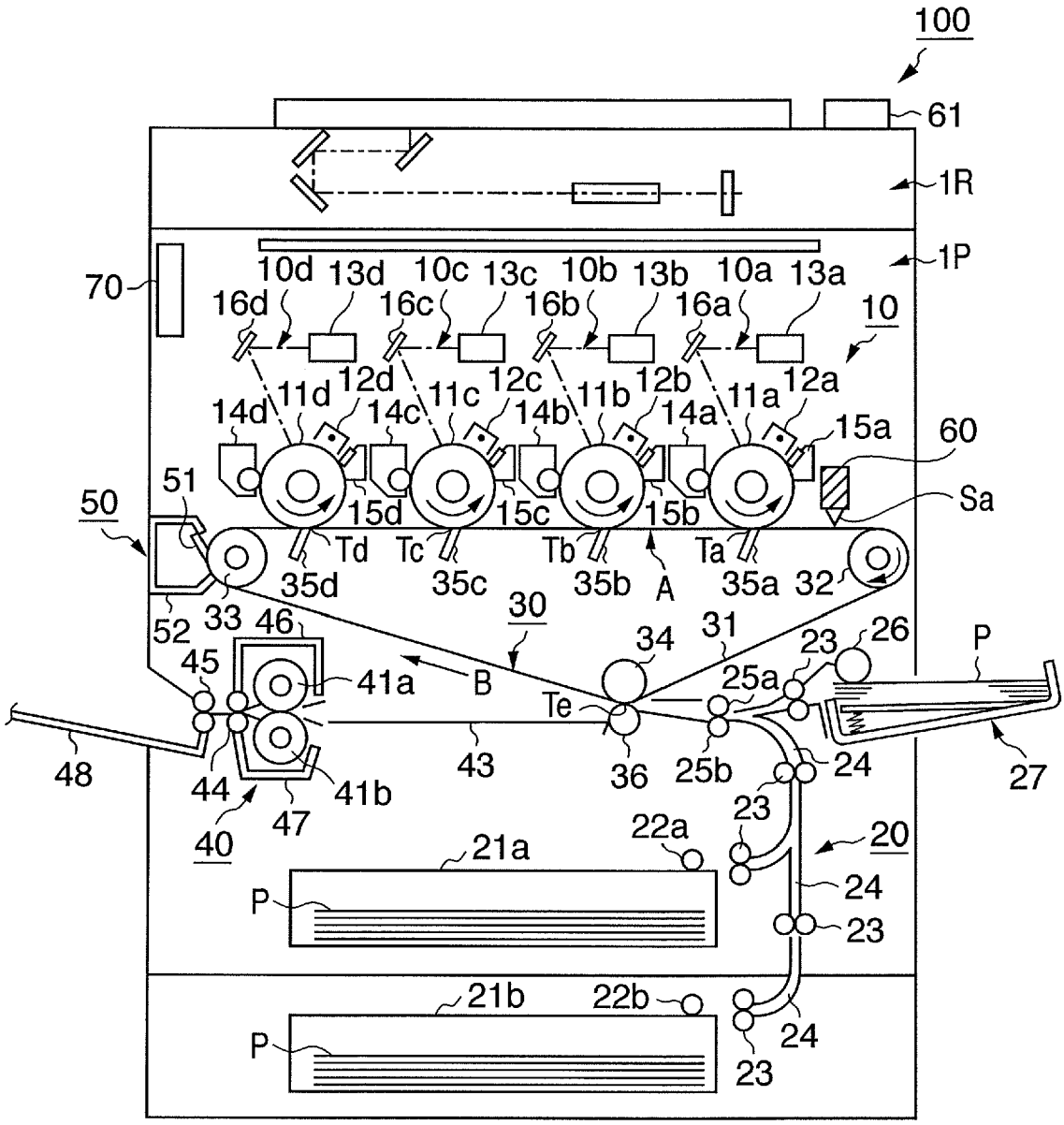
FIG. 1 is a sectional view schematically showing the overall structure of an electrophotographic color copying machine according to an embodiment of the present invention.

An embodiment of the present invention will be described below with reference to the accompanying drawings. FIG. 1 is a sectional view schematically showing the overall structure of an electrophotographic color copying machine (image forming apparatus) 100 according to the embodiment of the present invention. The electrophotographic color copying machine 100 includes a plurality of parallel image forming units corresponding to yellow, cyan, magenta, and black. The electrophotographic color copying machine 100 is a color image forming apparatus which adopts an intermediate transfer scheme. However, the gist of the present invention is not limited to a color image forming apparatus. For example, the present invention is applicable to a monochrome-dedicated image forming apparatus.

(Structure of Electrophotographic Color Copying Machine)

The electrophotographic color copying machine 100 comprises an image reading unit 1R and image output unit 1P. The image reading unit 1R optically reads document images, converts the read images into electrical signals, and sends them to the image output unit 1P. The image output unit 1P includes a plurality of image forming units 10, paper feed unit 20, intermediate transfer unit 30, fixing unit 40, cleaning unit 50, and control unit 70. This embodiment adopts four parallel image forming units 10, i.e., 10*a*, 10*b*, 10*c*, and 10*d*.

The control unit 70 counts information (containing a cumulative print count and a cumulative number of times of image formation) obtained by the image forming units 10*a*, 10*b*, 10*c*, and 10*d*. This information is called cumulative use information. The control unit 70 can also control display for advising the user of notice information which serves as a criterion until adjustment scheduled next. The control unit 70 can also control the adjustment execution timing on the basis of selection input by the user. Practical timing control will be described later with reference to FIGS. 3 to 5, and a detailed description thereof will be omitted here.

An operation unit 61 including an LCD display unit is arranged on the upper surface of the image reading unit 1R.

The image forming units 10*a*, 10*b*, 10*c*, and 10*d* have the same structure. The image forming units 10*a*, 10*b*, 10*c*, and 10*d* rotatably, pivotally support drum-shaped electrophotographic photosensitive bodies as first image carriers, i.e., photosensitive drums 11*a*, 11*b*, 11*c*, and 11*d*. The photosensitive drums 11*a*, 11*b*, 11*c*, and 11*d* are rotationally driven in the directions indicated by arrows. Primary chargers 12*a*, 12*b*, 12*c*, and 12*d*, optical systems 13*a*, 13*b*, 13*c*, and 13*d*, return mirrors 16*a*, 16*b*, 16*c*, and 16*d*, developing units 14*a*, 14*b*, 14*c*, and 14*d*, and cleaning units 15*a*, 15*b*, 15*c*, and 15*d* oppose the peripheral surfaces of the photosensitive drums 11*a* to 11*d* along their rotation directions.

The primary chargers 12*a* to 12*d* uniformly charge the surfaces of the photosensitive drums 11*a* to 11*d*. The optical systems 13*a* to 13*d* expose the surfaces of the photosensitive drums 11*a* to 11*d* via the return mirrors 16*a* to 16*d* by using light beams such as laser beams modulated in accordance with recording image signals from the image reading unit 1R, thus forming electrostatic latent images on the photosensitive drums 11*a* to 11*d*.

Moreover, the developing units 14*a* to 14*d* which store corresponding developing agents (to be referred to as "toners" hereinafter) of four colors, i.e., yellow, cyan, magenta, and black visualize the electrostatic latent images formed on the photosensitive drums 11*a* to 11*d*. The visualized images are transferred onto image transfer areas Ta, Tb, Tc, and Td of a belt-shaped intermediate transfer body, i.e., intermediate transfer belt 31. The intermediate transfer belt 31 serves as a second image carrier which forms the intermediate transfer unit 30. The intermediate transfer unit 30 will be described in detail later.

On the downstream sides of the image transfer areas Ta, Tb, Tc, and Td, the cleaning units 15*a*, 15*b*, 15*c*, and 15*d* clean the surfaces of the photosensitive drums 11*a* to 11*d* by scraping toners which remain on them without being transferred onto the intermediate transfer body. The above-described process allows to sequentially form images using respective toners.

The paper feed unit 20 comprises cassettes 21*a* and 21*b*, manual insertion tray 27, pickup rollers 22*a*, 22*b*, and 26, paper feed roller pair 23, paper feed guide 24, and registration rollers 25*a* and 25*b*. The cassettes 21*a* and 21*b* and manual insertion tray 27 store transfer materials P. The pickup roller 22*a* or 22*b* or 26 feeds transfer materials P one by one from the cassette 21*a* or 21*b* or 27. The paper feed roller pair 23 further conveys the transfer materials P fed from the pickup roller 22*a* or 22*b* or 26. The registration rollers 25*a* and 25*b* feed the transfer materials P to a secondary transfer area Te while matching with the image formation timings of the image forming units.

The intermediate transfer unit 30 will be described in detail next. The intermediate transfer belt 31 is wound around a driving roller 32, driven roller 33, and secondary transfer opposing roller 34 while being kept taut between them. The driving roller 32 transmits a driving force through the intermediate transfer belt 31. The driven roller 33 serves as a tension roller which applies an appropriate tension to the intermediate transfer belt 31 by biasing a spring (not shown). The driven roller 33 is driven by pivoting the intermediate transfer belt 31. A primary transfer plane A is formed between the driving roller 32 and the driven roller 33. The intermediate transfer belt 31 uses a material such as PET (polyethylene terephthalate) or PVDF (polyvinylidene fluoride) is used. The metallic surface of the driving roller 32 is coated with rubber (urethane or chloroprene) having a thickness of several mm so as to prevent it from slipping off the belt 31. A pulse motor (not shown) rotationally drives the driving roller 32 under the control of the control unit 70.

In each of the image transfer areas Ta to Td where each of the photosensitive drums 11*a* to 11*d* opposes the intermediate transfer belt 31, primary transfer chargers 35*a* to 35*d* are arranged on the reverse surface of the intermediate transfer belt 31. A secondary transfer roller 36 opposes the secondary transfer opposing roller 34. The secondary transfer area Te is formed by nipping between the secondary transfer roller 36 and the intermediate transfer belt 31. The secondary transfer roller 36 is pressed against the intermediate transfer belt 31 with an appropriate pressure.

The cleaning unit 50 to clean the image formation surface of the intermediate transfer belt 31 is arranged downstream of the secondary transfer area Te of the intermediate transfer belt 31. The cleaning unit 50 comprises a cleaning blade 51 to remove toner on the intermediate transfer belt 31, and a waste toner box 52 to store waste toner.

The fixing unit 40 comprises fixing rollers 41*a* and 41*b*, guide 43, fixing heat-insulating covers 46 and 47, internal paper discharge roller 44, external paper discharge roller 45, and paper discharge tray 48. The fixing roller 41*a* incorporates a heat source such as a halogen heater. The fixing roller 41*b* (which also incorporates a heat source in some cases) is pressed against the fixing roller 41*a*. The guide 43 guides a transfer material P to the nip portion between the pair of rollers 41*a* and 41*b*. The fixing heat-insulating covers 46 and 47 trap heat generated by the fixing unit 40 inside. The internal paper discharge roller 44 and external paper discharge roller 45 further guide the transfer material P discharged from the pair of rollers 41*a* and 41*b* outside the apparatus. The paper discharge tray 48 stacks the transfer materials P.

(Operation of Electrophotographic Color Copying Machine)

The operation of an electrophotographic color copying machine having the above-described structure will be described next. When the control unit 70 generates an image formation operation start signal, an operation for feeding transfer materials P from the cassette 21*a* or 21*b* or the like corresponding to, e.g., a selected paper size starts.

A case wherein transfer materials P are fed from the cassette 21*a* corresponding to the upper stage will be exemplified. Referring to FIG. 1, the transfer materials P are fed from the cassette 21*a* one by one by the pickup roller 22*a*. The transfer material P is guided through the paper feed guide 24 by the paper feed roller pair 23 and conveyed to the registration rollers 25*a* and 25*b*. At this time, the registration rollers 25*a* and 25*b* are stopped and the leading end of the transfer material P abuts against the nip portion. Subsequently, the registration rollers 25*a* and 25*b* start rotation while matching a timing when the image forming units start image formation. The rotation timing of the registration rollers 25*a* and 25*b* is set such that a transfer material P and a toner image primarily transferred onto the intermediate transfer belt 31 by the image forming units coincide with each other in the secondary transfer area Te.

When the control unit 70 generates an image formation operation start signal, the image forming units 10*a*, 10*b*, 10*c*, and 10*d* form toner images. With the above-described process, a toner image formed on the photosensitive drum 11*d* located on the most upstream side with respect to the rotation direction of the intermediate transfer belt 31 is primarily transferred onto the image transfer area Td of the intermediate transfer belt 31 by the primary transfer charger 35*d* to which a high voltage is applied. The primarily transferred toner image is conveyed to the next primary image transfer area Tc. In the image transfer area Tc, an image is formed with a delay of a time during which the toner image is conveyed among the image forming units. The next toner image is transferred by adjusting registration onto the previous image. By repeating the same process hereinafter, a four-color toner image is primarily transferred onto the intermediate transfer belt 31.

Subsequently, the transfer material P enters the secondary transfer area Te and come into contact with the intermediate transfer belt 31. Under the control of the control unit 70, a high voltage is applied to the secondary transfer roller 36 while matching a timing when the transfer material P passes. With this operation, the four-color toner image formed on the intermediate transfer belt 31 by the above-described process is transferred onto the surface of the transfer material P. After that, the convey guide 43 guides the transfer material P exactly to the nip portion between the fixing rollers 41*a* and 41*b*. The full-color toner image is fixed to the surface of the transfer material P by heat due to the pair of rollers 41*a* and 41*b* and a pressure due to their nip portion. The transfer material P is conveyed by the internal paper discharge roller 44 and external paper discharge roller 45, discharged outside the apparatus, and stacked on the paper discharge tray 48.

(Explanation of Image Adjustment Processes)

Image adjustment processes according to this embodiment will be described next. In order to prevent a change in image density or color misregistration of a color image from occurring depending on a change in use environment or various conditions such as a cumulative print count or a cumulative number of times of image formation, the electrophotographic color copying machine (image forming apparatus) 100 can periodically execute an image adjustment process (e.g., density adjustment control or registration adjustment control) to correct these factors. Density adjustment control and registration adjustment control will be described below as the image adjustment processes. Details of the execution timings of these image adjustment processes will be described later.

This embodiment exemplifies density adjustment control and registration adjustment control as the image adjustment processes. However, the gist of the present invention is not limited to these processes. For example, it is possible to control, on the basis of user's selection, the execution timings of image adjustments such as execution of a cleaning operation for causing the cleaning unit 50 to clean the image forming units, image formation potential adjustment for adjusting a potential required to charge the photosensitive drums, transfer potential adjustment for adjusting a transfer potential required to transfer a formed toner image, and execution of another adjustment control for maintaining the quality of an image to be formed.

(Density Adjustment Control)

Density adjustment control will be exemplified as the image adjustment process. To execute density adjustment control, toner patterns are formed on the photosensitive drums 11*a* to 11*d* and primarily transferred onto the intermediate transfer belt 31. A toner pattern reading sensor 60 detects the resultant pattern to adjust an image formation condition corresponding to the measurement result. The toner pattern reading sensor 60 causes a light-receiving element such as a photodiode to receive light which is emitted by a light-emitting element such as an LED and reflected by a toner pattern.

The electrophotographic color copying machine (image forming apparatus) 100 according to this embodiment has a density correction function and tone adjustment function as density adjustment control functions. The density correction function serves to detect the density of a toner pattern formed while changing the developing bias value and to feed back the measurement result to that developing bias value. The tone adjustment function serves to detect the density of a toner pattern formed while maintaining a developing bias and changing the exposure amount and to feed back the measurement result to the exposure amount.

(Registration Adjustment Control)

Registration adjustment control will be exemplified as the image adjustment process. Similar to density adjustment control, registration adjustment control is done on the basis of a detection result obtained by causing the toner pattern reading sensor 60 to detect a toner pattern. However, registration adjustment control is different from density adjustment control in that the toner pattern reading sensor 60 measures the toner pattern arrival timing instead of the density of a toner pattern. In registration adjustment control, the toner pattern reading sensor 60 measures the toner pattern arrival timing to feed back the measurement result to the control unit 70. The control unit 70 controls the image formation start timings of the photosensitive drums 11*a* to 11*d* on the basis of the measurement result obtained by the toner pattern reading sensor 60, thereby correcting color misregistration.

(Execution Conditions of Density Adjustment Control and Registration Adjustment Control)

The execution conditions of density adjustment control and registration control which are executed under the control of the control unit 70 will be described next. The electrophotographic color copying machine (image forming apparatus) 100 according to this embodiment periodically, simultaneously executes density adjustment control and registration control in accordance with a cumulative print count (these two operations will be collectively referred to as "image adjustment control" hereinafter). This makes it possible to prevent frequent adjustment control execution, though a time required for one adjustment control prolongs as compared with separate adjustment control execution.

The control unit 70 determines the necessity of image adjustment control. If, for example, a condition "<condition 1> job in progress: execute adjustment if cumulative print count has reached 200" is defined as a necessity determination criterion of image adjustment control, the control unit 70 compares the cumulative print count value with "200" as the determination criterion. If the cumulative print count has reached a predetermined count set in "condition 1", the control unit 70 determines that image adjustment control is necessary. The control unit 70 clears the cumulative print count to 0 after executing the current image adjustment control and prepares for the next image adjustment control.

Since this embodiment allows to synchronously execute density adjustment control and registration adjustment control, the control unit 70 determines the necessity of adjustment control under the same determination condition (condition 1 described above). However, it is also possible to set determination conditions separately for these control operations. In this case, the control unit 70 can determine the necessity of adjustment control on the basis of the result of comparison between cumulative print counts corresponding to the respective control operations and determination conditions set separately for these control operations.

In addition to adjustments associated with density adjustment control and registration adjustment control, when, for example, performing the cleaning operation by the cleaning unit 50 and another adjustment control for maintaining the quality of an image to be formed, it is possible to set a determination condition different from the determination condition (condition 1 described above) for determining the adjustment timing. In this case, the control unit 70 measures various conditions such as a cumulative print count and a cumulative number of times of image formation, and determines whether the measured various conditions have reached set determination conditions.

The image adjustment control execution timings will be described with reference to the flowchart in FIG. 3 and a display example of an LCD shown in FIG. 4.

After powering on the electrophotographic color copying machine 100, the flow advances to step S301. The electrophotographic color copying machine 100 enters a standby state to wait a print start instruction. If the control unit 70 determines in step S301 that the user has issued a print start instruction (YES in step S301), the flow advances to step S302.

Figure 4:
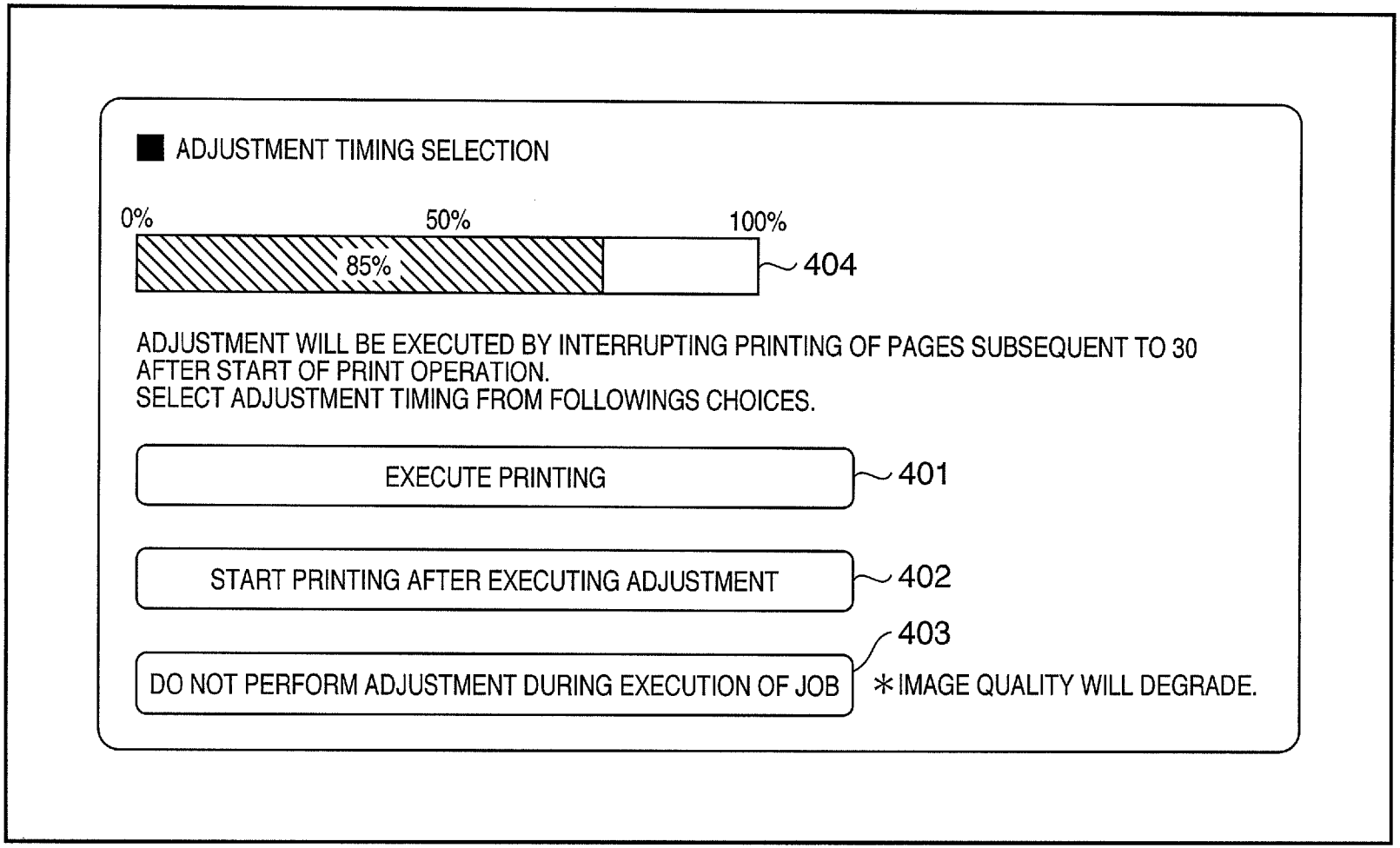
FIG. 4 is a view showing LCD display for adjustment timing selection according to the embodiment of the present invention.

In step S302, an adjustment timing selection window as shown in FIG. 4 is displayed on the LCD on an operation unit (not shown). This LCD display is based on display control by the control unit 70.

If the user selects "execute printing" denoted by reference numeral 401 for designating automatic adjustment on the LCD here, the control unit 70 sets a variable (mode) indicating an adjustment mode to "3".

If the user selects "start printing after adjustment execution" denoted by reference numeral 402 for designating image adjustment control execution before the start of a job on the LCD, the control unit 70 sets a variable (mode) indicating an adjustment mode to "1". If the user selects "do not perform adjustment during execution of job" denoted by reference numeral 403 for designating image adjustment control inhibition during execution of a job, the control unit 70 sets a variable (mode) indicating an adjustment mode to "2". When the user selects any one of adjustment modes on the LCD, the flow advances to step S303. If the user inputs nothing within a predetermined time on the adjustment timing selection window shown in FIG. 4, the control unit 70 may set an adjustment mode to the default value to automatically advance the flow to step S303.

The control unit 70 determines in step S303 whether the value of a variable (mode) indicating an adjustment mode is "1". If the value of the variable (mode) is "1" (YES in step S303), the flow advances to step S304. The above-described image adjustment control is executed under the control of the control unit 70 in step S304. After completing adjustment, the control unit 70 clears the cumulative print count as a criterion for automatic adjustment execution in step S305. After clearing the cumulative print count, the flow advances to step S306.

If the control unit 70 determines in step S303 that the value of the variable (mode) is not "1", the flow advances to step S306. A print operation is executed under the control of the control unit 70.

At this time, the control unit 70 cumulatively increments the print count followed by the print operation in step S307.

The control unit 70 determines in step S308 whether the value of a variable (mode) indicating an adjustment mode is "2". If the value of the variable (mode) is "2" (YES in step S308), the flow advances to step S309. If the control unit 70 determines in step S308 that the value of the variable (mode) is not "2", the flow advances to step S312.

In step S309, the control unit 70 compares a cumulative print count with a print count (e.g., "200" set in condition 1) as a necessity determination criterion of image adjustment control. If the cumulative print count has reached "200" (YES in step S309), the flow advances to step S310. The above-described image adjustment control is executed under the control of the control unit 70 in step S310. After adjustment, the control unit 70 clears the cumulative print count as a criterion for automatic adjustment execution in step S311. After clearing the cumulative print count, the flow advances to step S312.

The control unit 70 determines in step S312 whether printing of all the pages is complete. If the next page is to be printed (NO in step S312), the flow returns to step S306 to execute the processes from step S306 in the same way.

If the control unit 70 determines in step S312 that printing of all the pages is complete and no next page is to be printed (YES in step S312), it compares a cumulative print count with a print count (e.g., "200") as a determination criterion. If the cumulative print count has reached "200" (YES in step S313), the flow advances to step S314. The above-described image adjustment control is executed under the control of the control unit 70 in step S314. After completing adjustment, the control unit 70 clears the cumulative print count as a criterion for automatic adjustment execution in step S315. If the control unit 70 determines in step S313 that the cumulative print count has not reached the print count as the determination criterion yet, image adjustment control is not executed. The flow returns to step S301.

Figures 2A, 2B, 2C:
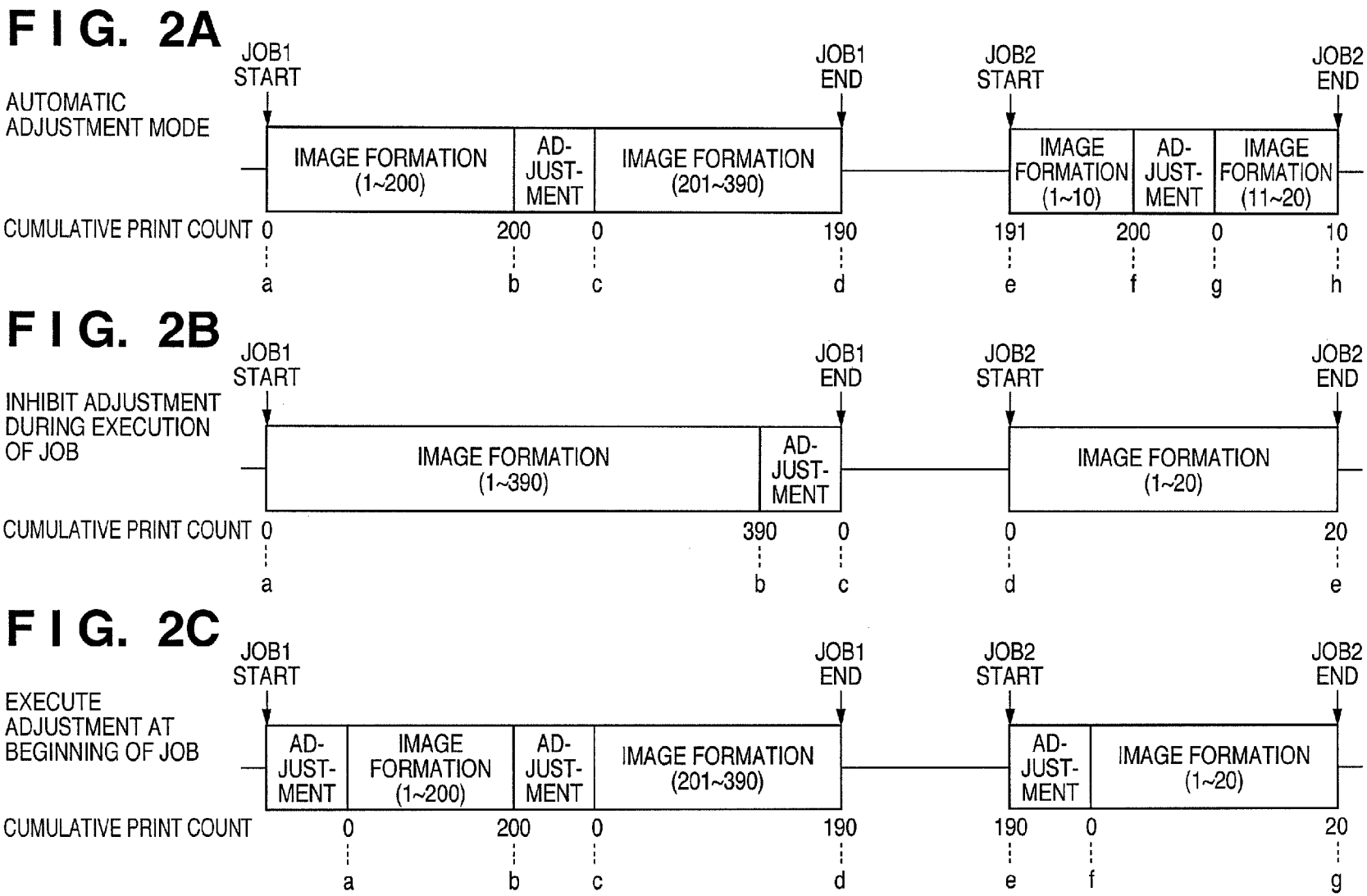
FIGS. 2A to 2C are timing charts for explaining the adjustment start timings according to the embodiment of the present invention.

The adjustment start timings will be described next with reference to FIGS. 2A to 2C. FIGS. 2A to 2C exemplify, as an operation example, a case wherein job 2 (including 20 pages to be printed) is executed after executing job 1 (including 390 pages to be printed) for starting print processes while a cumulative print count is 0.

FIG. 2A is a timing chart showing the image adjustment control execution timing when the user instructs, via the adjustment timing selection window shown in FIG. 4, to "execute printing" denoted by reference numeral 401 for designating automatic adjustment.

In FIG. 2A, like in the prior arts, the control unit 70 executes image adjustment control at the same timing as that of image adjustment control. When processing of job 1 starts under the control of the control unit 70 (FIG. 2A-*a*), its pages are sequentially printed. A cumulative print count is incremented by one every page printing. The control unit 70 compares a cumulative print count with a print count (e.g., "200" set in condition 1) as a determination criterion. If the cumulative print count has reached "200", the control unit 70 temporarily interrupts the print operation to execute image adjustment control (density adjustment control and registration adjustment control) (FIG. 2A-*b*). After completing image adjustment control, the control unit 70 clears the cumulative print count to 0 to restart the print operation (FIG. 2A-*c*). After completing printing of the last page of job 1, the cumulative print count becomes 190. The control unit 70 then returns to a standby state and becomes ready to accept the next job (FIG. 2A-*d*).

When processing of job 2 (including 20 pages to be printed) starts under the control of the control unit 70 (FIG. 2A-*e*), its pages are sequentially printed. A cumulative print count is incremented by one every page printing. When printing of 10 pages is complete, the control unit 70 determines that the cumulative print count has reached 200. The control unit 70 temporarily interrupts the print operation to execute image adjustment control (density adjustment control and registration adjustment control) (FIG. 2A-*f*). After completing image adjustment control, the control unit 70 clears the cumulative print count to 0 to restart the print operation (FIG. 2A-*g*). After completing printing of the last page of job 2, the cumulative print count becomes 10. The control unit 70 then returns to a standby state and becomes ready to accept the next job (FIG. 2A-*h*).

FIG. 2B is a timing chart showing the image adjustment control execution timing when the user instructs, via the adjustment timing selection window shown in FIG. 4, to "do not perform adjustment during execution of job" denoted by reference numeral 403 for designating image adjustment control inhibition during execution of a job.

In FIG. 2B, when processing of job 1 starts under the control of the control unit 70 (FIG. 2B-*a*), its pages are sequentially printed. A cumulative print count is incremented by one every page printing. The control unit 70 does not execute image adjustment control until a print operation of 390 pages including the last page of job 1 is complete. After completing printing of all the pages, the control unit 70 compares a cumulative print count with a print count as a determination criterion (e.g., "200" set in condition 1). If the cumulative print count exceeds "200", the control unit 70 executes image adjustment control (FIG. 2B-*b*). After completing image adjustment control, the control unit 70 clears the cumulative print count to 0 (FIG. 2B-*c*) to start a print operation associated with the next job 2 (FIG. 2B-*d*). After completing printing of all the pages of job 2, the control unit 70 compares a cumulative print count with a print count as a determination criterion (e.g., "200" set in condition 1). If the cumulative print count has reached "200", the control unit 70 executes image adjustment control. In this case, the cumulative print count is 20 (FIG. 2B-*e*). The control unit 70 then returns to a standby state without executing image adjustment control and becomes ready to accept the next job.

FIG. 2C is a timing chart showing the image adjustment control execution timing when the user instructs, via the adjustment timing selection window shown in FIG. 4, to "start printing after adjustment execution" denoted by reference numeral 402 for designating image adjustment control execution before the start of a job.

In FIG. 2C, when processing of job 1 starts under the control of the control unit 70, it executes the above-described image adjustment control and then clears the cumulative print count to 0 (FIG. 2C-*a*). Subsequently, the pages of job 1 are sequentially printed under the control of the control unit 70. A cumulative print count is incremented by one every page printing. The control unit 70 compares a cumulative print count with a print count (e.g., "200" set in condition 1) as a determination criterion. If the cumulative print count has reached "200", the control unit 70 temporarily interrupts the print operation to execute image adjustment control (FIG. 2C-*b*). After completing image adjustment control, the control unit 70 clears the cumulative print count to 0 to restart the print operation (FIG. 2C-*c*). After completing printing of the last page of job 1, the cumulative print count becomes 190. The control unit 70 then returns to a standby state and becomes ready to accept the next job (FIG. 2C-*d*).

When processing of job 2 (including 20 pages to be printed) starts under the control of the control unit 70 (FIG. 2C-*e*), it executes the above-described image adjustment control and then clears the cumulative print count to 0 (FIG. 2C-*f*). Subsequently, when processing of job 2 (including 20 pages to be printed) starts, its pages are sequentially printed. A cumulative print count is incremented by one every page printing. The control unit 70 compares a cumulative print count with a print count (e.g., "200" set in condition 1) as a determination criterion. If the cumulative print count has reached "200", the control unit 70 temporarily interrupts the print operation to execute image adjustment control. In this case, since job 2 includes a total of 20 pages, the cumulative print count will never reach 200. Execution of job 2 is therefore completed without executing image adjustment control (FIG. 2C-*e*). When execution of job 2 is complete, the cumulative print count is 20. However, since the control unit 70 executes image adjustment control before the succeeding job starts, it clears the cumulative print count to 0 at the beginning of that job.

Timing control associated with the above-described image adjustment is not limited to density adjustment control and registration adjustment control. Timing control is even applicable to a case wherein the cleaning unit 50 is activated under the control of the control unit 70. In this case, the control unit 70 activates the cleaning unit 50 at a predetermined timing (e.g., a timing when printing starts after executing cleaning, when cleaning is not performed during execution of a job, or when cleaning is executed on the basis of comparison between a cumulative print count and a print count set as a determination condition) so as to clean the image formation surface of the intermediate transfer belt 31.

(Advising with Respect to User)

The control unit 70 can control display for advising the user of adjustment notice information which serves as a criterion until the next image adjustment execution.

FIG. 4 illustrates an LCD display window to select the adjustment timing. Through this window which displays a bar graph 404 in combination with the messages 401, 402, and 403 in selection input portions to select an adjustment mode, the control unit 70 advises the user of visually/sensuously recognizable adjustment notice information which serves as a criterion until the next image adjustment execution. Together with the bar graph 404, the control unit 70 advises the user of quantitative notice information about the next image adjustment execution timing, i.e., a remaining print count until the adjustment timing comes.

The bar graph 404 in FIG. 4 advises the user of a criterion of the current cumulative print count with respect to a print count (e.g., 200 is set in this embodiment) set as a determination condition. Assume, for example, that the current cumulative print count is 170. By calculating 170 (pages) ÷200 (pages)×100, the control unit 70 can display, on the window on the LCD, that the current cumulative print count is 85% of 200 as a criterion of the adjustment interval (the control unit 70 displays the ratio of the cumulative print count to the adjustment interval). Together with the bar graph 404, the control unit 70 displays a remaining print count until the adjustment timing comes. With this operation, the control unit 70 advises the user of visual/sensuous, quantitative notice information about the adjustment timing.

On the basis of the display result as the combination of this bar graph and the remaining print count until the adjustment timing comes, the user can appropriately select, on the same window, whether to perform adjustment in an automatic adjustment mode during execution of a job denoted by reference numeral 401 in FIG. 4, whether to execute adjustment before the start of a job denoted by reference numeral 402 in FIG. 4, or whether to inhibit adjustment during execution of a job denoted by reference numeral 403 in FIG. 4. That is, the user can grasp a criterion until the next image adjustment process execution, so as to select the image adjustment process execution timing.

Figure 5:
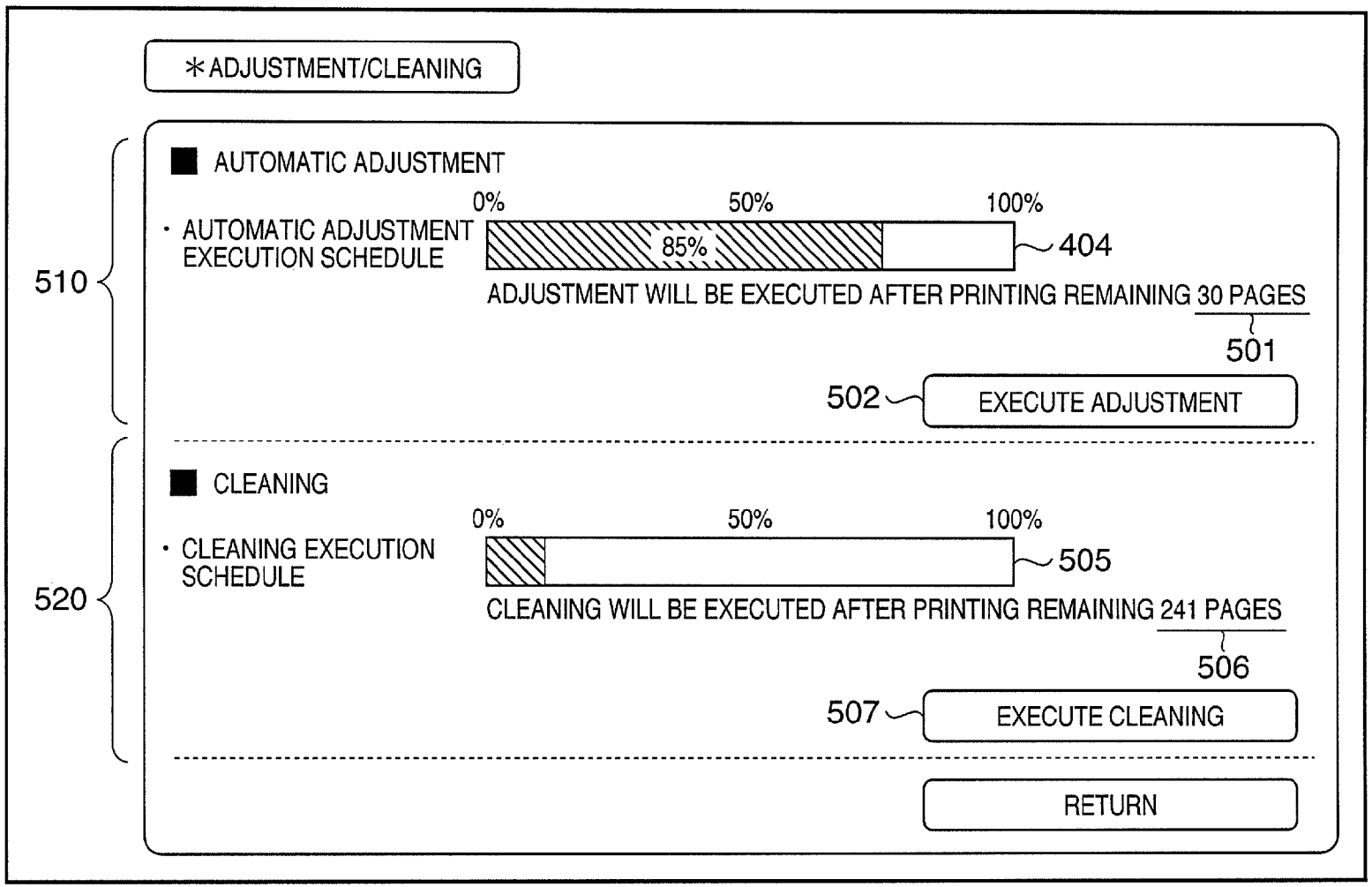
FIG. 5 is a view illustrating a window on the LCD, which advises the user of adjustment/cleaning notice information which serves as a criterion until the next image adjustment execution according to the embodiment of the present invention.

FIG. 5 is a view illustrating a window on an LCD to advise the user of adjustment/cleaning notice information which serves as a criterion until the next image adjustment execution. The control unit 70 controls to display a window including a combination of notice information which serves as a criterion during the period from when the current job is complete until the next image adjustment execution, and cleaning notice information which serves as a criterion until the next cleaning operation execution by the cleaning unit 50.

An adjustment notice information display portion 510 displays a bar graph 404, a print count denoted by reference numeral 501 (in FIG. 5, 30 pages (=200 (pages)−170 (pages)) until the next image adjustment operation execution, and an adjustment execution key denoted by reference numeral 502 to allow the user to manually input a selection for executing adjustment at the current point. When the user presses the adjustment execution key denoted by reference numeral 502, the control unit 70 can shift the process to image adjustment operation execution, irrespective of the cumulative print count.

A cleaning notice information display portion 520 displays a cleaning execution schedule bar graph 505 which advises the user of the current cumulative print count as a criterion with respect to a set print count, a print count denoted by reference numeral 506 until the next cleaning operation execution, and a cleaning execution key denoted by reference numeral 507 to allow the user to manually input a selection for executing cleaning at the current point. When the user presses the cleaning execution key denoted by reference numeral 507, the control unit 70 can shift the process to cleaning operation execution, irrespective of the cumulative print count.

According to display in FIG. 5, when, e.g., automatically performing density adjustment control or registration adjustment control as adjustment control for maintaining the image quality, or when performing a cleaning operation or the like, the control unit 70 visualizes and advises the user of notice information which serves as a criterion until the next execution. When the user determines that the degree of degradation in image quality is large, he/she presses the adjustment execution key denoted by reference numeral 502 or cleaning execution key denoted by reference numeral 507, irrespective of the selection setting of the adjustment timing described with reference to FIG. 4. This makes it possible to select the execution timing of, e.g., adjustment to immediately execute the image adjustment process.

As described above, according to this embodiment, it is possible to provide an image forming technique for allowing the user to grasp a criterion until the next image adjustment process execution, so as to select an image adjustment process execution schedule in accordance with the degree of image degradation and an image formation job to be processed.

This makes it possible to avoid wastefully repeating an image adjustment process and to prevent the occurrence of a variation in image quality and a delay in processing time upon starting the image adjustment process.

Other Embodiment

The object of the present invention is achieved even by supplying a storage medium (or recording medium) which records software program codes for implementing the functions of the above-described embodiment to the system or apparatus and causing the computer (or CPU or MPU) of the system or apparatus to read out and execute the program codes stored in the storage medium.

In this case, the program codes read out from the storage medium implement the functions of the above-described embodiment by themselves, and the storage medium which stores the program codes constitutes the present invention. The functions of the above-described embodiments are implemented not only when the readout program codes are executed by the computer but also when the operating system (OS) running on the computer performs part or all of actual processing on the basis of the instructions of the program codes.

The functions of the above-described embodiment are also implemented when the program codes read out from the storage medium are written in the memory of a function expansion card inserted into the computer or a function expansion unit connected to the computer, and the CPU of the function expansion card or function expansion unit performs part or all of actual processing on the basis of the instructions of the program codes.

Figure 3:
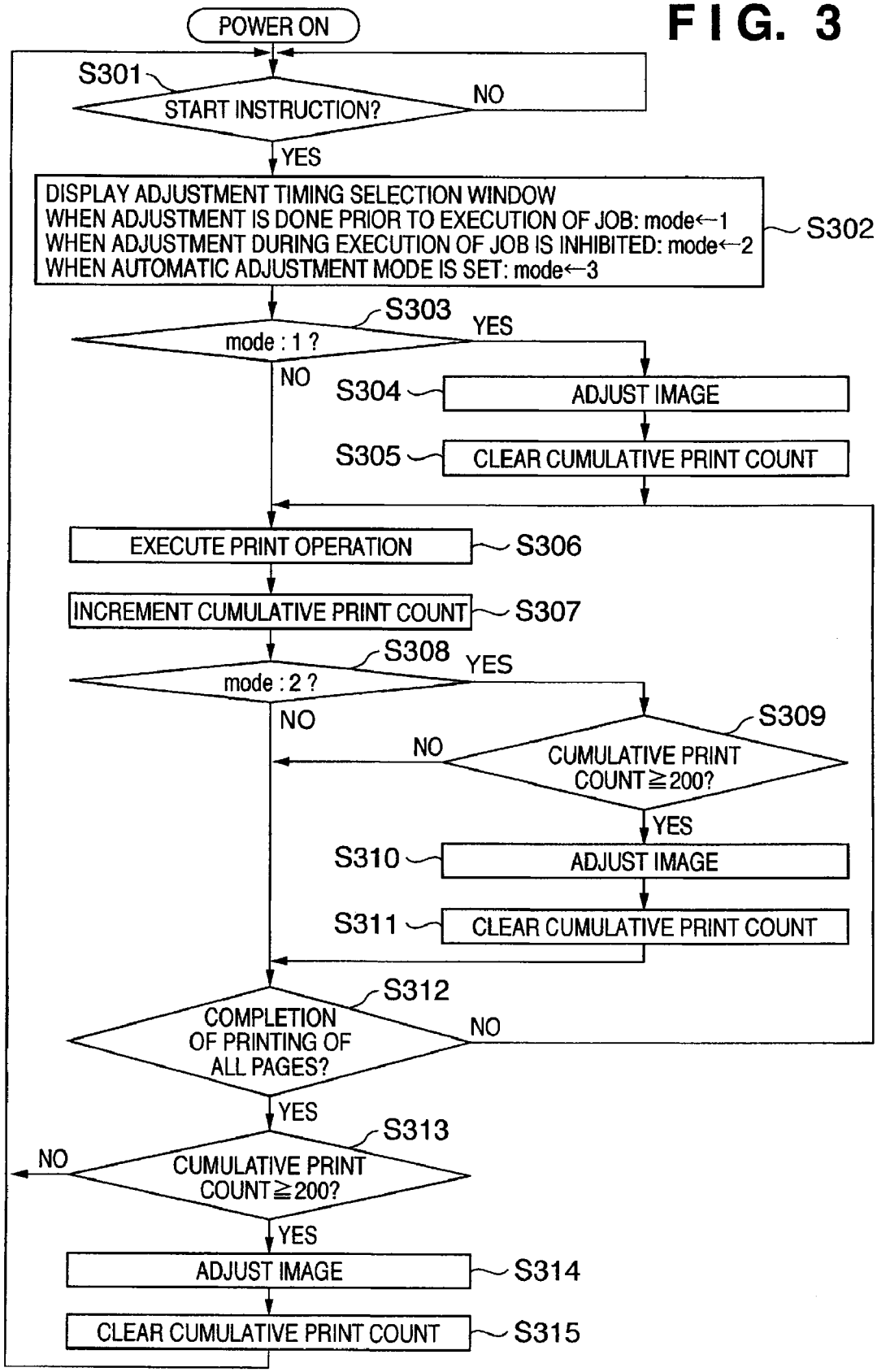
FIG. 3 is a flowchart for explaining the image adjustment control execution timings according to the embodiment of the present invention.

When the present invention is applied to the storage medium, it stores program codes corresponding to the flowchart in FIG. 3 described above.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-260903, filed on Sep. 8, 2005, which is hereby incorporated by reference herein in its entirety.

What is claimed is:

1. An image forming apparatus comprising:

an adjustment unit adapted to adjust an image to be formed by an image forming unit;

a display control unit adapted to advise a combination of quantitative information indicating a next adjustment timing obtained by said adjustment unit and ratio information of cumulative use information obtained by said image forming unit to an adjustment interval obtained by said adjustment unit; and a timing control unit adapted to change the advised adjustment timing to be earlier or later than the next adjustment timing on the basis of selection input, wherein said display control unit displays, on the same display unit, the advised combination of the quantitative information and the ratio information and a selection input window to change the adjustment timing.

2. The apparatus according to claim 1, wherein said timing control unit causes said adjustment unit to execute, on the basis of the selection input, adjustment before start of execution of an image formation job.

3. The apparatus according to claim 1, wherein said timing control unit inhibits, on the basis of the selection input, said adjustment unit from executing adjustment until an image formation job is complete.

4. The apparatus according to claim 1, wherein the adjustment includes at least one of density adjustment, registration adjustment, cleaning of said image forming unit, image formation potential adjustment, and transfer potential adjustment.

* * * * *

UNITED STATES PATENT AND TRADEMARK OFFICE

CERTIFICATE OF CORRECTION

PATENT NO. : 7,433,621 B2
APPLICATION NO. : 11/470702
DATED : October 7, 2008
INVENTOR(S) : Seiji Shibaki et al.

It is certified that error appears in the above-identified patent and that said Letters Patent is hereby corrected as shown below:

Title Page

In the Section (75) Titled "Inventors" correct First Inventors name as follows:

FROM: Sejii SHIBAKI

TO: --Seiji SHIBAKI--

Signed and Sealed this

Second Day of December, 2008

JON W. DUDAS
*Director of the United States Patent and Trademark Office*